US006254051B1

(12) United States Patent
Hubbard et al.

(10) Patent No.: US 6,254,051 B1
(45) **Date of Patent: *Jul. 3, 2001**

(54) RESTRAINING SYSTEM FOR WATER HEATERS

(75) Inventors: Kirt R. Hubbard, La Jolla; Larry D. Brown, San Diego, both of CA (US)

(73) Assignee: Securus, Inc., San Marcos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/006,084

(22) Filed: Jan. 14, 1998

Related U.S. Application Data

(60) Provisional application No. 60/035,511, filed on Jan. 15, 1997, and provisional application No. 60/048,361, filed on Jun. 2, 1997.

(51) Int. Cl.[7] ..... A47K 1/08

(52) U.S. Cl. ..... 248/313; 248/505; 24/280; 126/24

(58) Field of Search ..... 248/313, 154, 248/309.1, 146, 74.3, 74.1, 505, 499, 311.2, 231; 220/480, 481, 565; 24/20 LS, 284, 280, 279; 126/354, 24, 363; 431/343; 292/256.67

(56) References Cited

U.S. PATENT DOCUMENTS

| | | | | |
|---|---|---|---|---|
| 1,986,748 | * | 1/1935 | Pritchard | 24/281 |
| 2,147,127 | * | 2/1939 | Payne | 24/280 |
| 2,277,738 | * | 3/1942 | Wilkinson | 248/311.2 |
| 3,579,754 | * | 5/1971 | Oetiker | 24/279 |
| 4,020,531 | | 5/1977 | Ahrens et al. | 24/284 |
| 4,783,030 | | 11/1988 | Buerhop | 248/744 |
| 4,955,573 | | 9/1990 | Horvath | 248/313 |
| 5,020,760 | | 6/1991 | Mayr | 248/313 |
| 5,085,387 | | 2/1992 | Peterson et al. | 248/154 |
| 5,131,133 | | 7/1992 | Peterson et al. | 29/525.1 |
| 5,190,260 | | 3/1993 | Daubenspeck | 248/313 |
| 5,393,024 | | 2/1995 | Daubenspeck | 248/313 |
| 5,487,518 | | 1/1996 | McCraney et al. | 248/225.11 |
| 5,607,133 | * | 3/1997 | Markham et al. | 248/313 |

FOREIGN PATENT DOCUMENTS

| | | | | |
|---|---|---|---|---|
| 1087232 | * | 11/1953 | (FR) | 248/231 |

OTHER PUBLICATIONS

Spacemaker TS–E–25, 2 pages of installation instructions (undated).

* cited by examiner

*Primary Examiner*—Leslie A. Braun
*Assistant Examiner*—Gwendolyn Baxter
(74) *Attorney, Agent, or Firm*—Stetina Brunda Garred & Brucker

(57) ABSTRACT

A water heater is restrained against movement, such as during an earthquake, by a restraining system. The restraining system includes a pair of adjustable straps, which accommodate water heaters of various sizes. One end of each strap is securely attached to a supporting surface, such as a wall. The other end of the straps contain a plurality of slots configured to receive a connector. A connector is positioned in a desired slot or slots in each strap such that when the straps are placed around the water heater, the connectors are positioned proximate to each other. An adjustable fastener such as a bolt is inserted through an aperture in each connector to adjustably fasten the connectors together. The adjustable connector allows fine adjustment of the tension of straps around the water heater.

54 Claims, 10 Drawing Sheets

FIG. 11
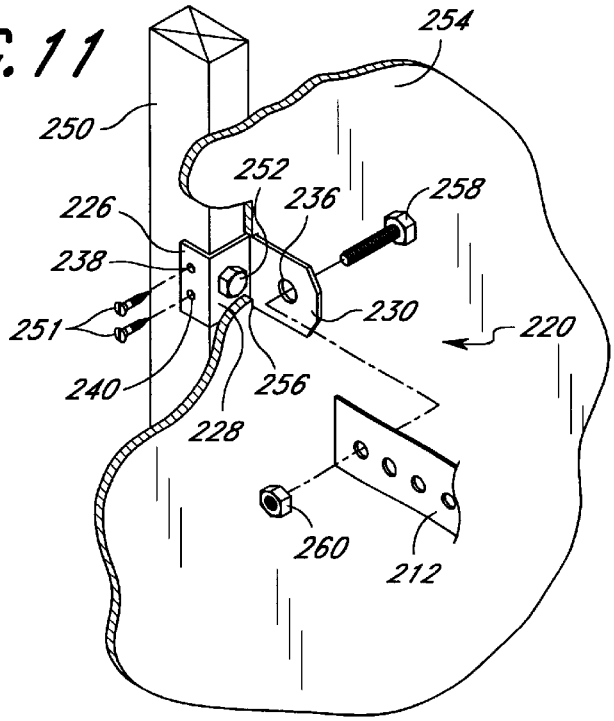
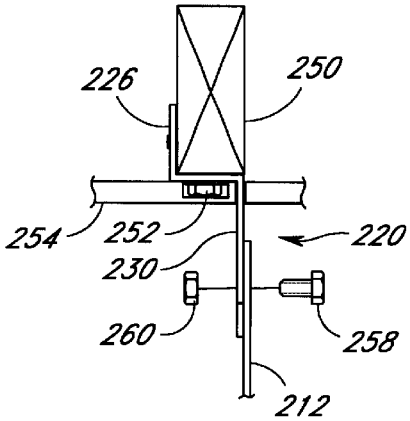
FIG. 12
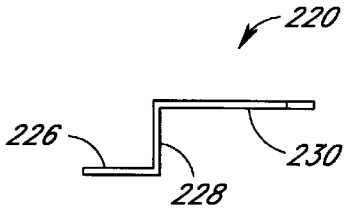
FIG. 13
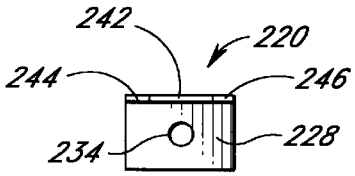
FIG. 14
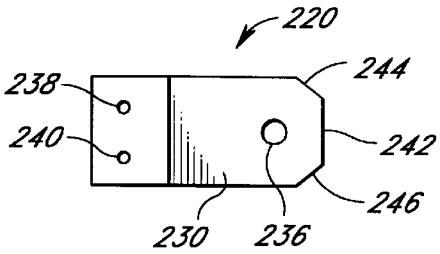
FIG. 15

RESTRAINING SYSTEM FOR WATER HEATERS

This application clain benefit to Provisional application Ser. No. 60/035,511 filed Jan. 15, 1997, which claims benefit to Provisional application Ser. No. 60/048,361, filed Jun. 2, 1997.

BACKGROUND OF THE INVENTION

This invention relates generally to water heaters and, in particular, to a system for restraining water heaters.

Conventional water heaters are generally cylindrical in overall shape, often between about four and six feet tall, and placed in an upright position. It is important for water heaters to remain in an upright position, in spite of disturbances such as earthquakes. A conventional method for securing a water heater in an upright position is to wrap a simple cable or strap around the water heater and attach the cable or strap to a nearby wall. This method, however, is unsatisfactory because the water heater is often an unknown distance from the wall and water heaters typically have different sizes. Thus, cables or straps of various lengths are required, and installation time is lengthened. Additionally, these simple cables or straps can be very difficult to install, and it is very difficult to obtain the proper tension in the cables or straps around the water heater. Therefore, the water heater is often improperly supported.

SUMMARY OF THE INVENTION

The present invention is a simple and economical system for restraining water heaters. Advantageously, the system is readily adjustable to restrain water heaters of various sizes. For example, the restraining system can restrain residential water heaters, which typically contain 30, 40 or 50 gallons of water. The restraining system can also restrain larger and smaller water heaters, and commercial water heaters. The restraining system is also readily adjustable to restrain water heaters located at various distances from a supporting structure, such as a wall. Additionally, the system is relatively inexpensive to manufacture because it has few parts and the parts have relatively simple construction. Further, the system provides for fast and efficient installation because the system is easy to assemble and readily adjustable.

In one embodiment of the present invention, the restraining system includes a first strap having a first end connected to a support structure and a second end containing a plurality of slots. A second strap has a first end connected to the support structure and a second end containing plurality of slots. The restraining system also includes a first connector including an extension configured to extend through a selected slot in the first strap and a second connector including an extension configured to extend through a selected slot in the second strap. Additionally, the system includes an adjustable fastener configured to connect the first and second connectors. The slot which is selected in the first strap and the slot which is selected in the second strap are selected for coarse adjustment of the straps around the water heater, and the adjustable fastener is configured to tighten the straps around the water heater to achieve the desired fit of the straps around the water heater.

In another embodiment of the invention, the restraining system further includes a bracket connected to a supporting structure and a pair of wedges connected to the bracket. Each wedge includes a first leg and a second leg, with the first leg of each wedge configured to engage the water heater.

In yet another embodiment of the invention, a mounting bracket with a generally "Z"-shaped configuration has a first section for engagement with an inner surface of a supporting member, a second section extending generally perpendicular to the first for engagement with the front face of the supporting member, and a third or attachment section extending generally perpendicular to the second section (and generally parallel to the first section). The bracket includes a through-hole in its second section through which a fastener may be extended for connecting the bracket to the front face of the supporting member and the bracket may include a pair of through-holes in the first section through which additional fasteners may be extended. Desirably, when a wall covering is installed over the front face of the supporting member, the attachment section of the bracket extends through the wall covering and includes a point of attachment for the end of a strap or other restraint.

The invention also includes a method of restraining a water heater; the method includes the steps of attaching a first strap with a plurality of apertures to a supporting structure and attaching a second strap with a plurality of apertures to a supporting structure. A first connector is inserted through selected slots in the first strap and a second connector is inserted through selected slots in the second strap. An adjustable fastener connects the first and second connectors. The adjustable fastener is preferably configured to tighten the first strap and the second strap around the water heater.

In another method of restraining a water heater, two Z-shaped brackets are each mounted to different supporting members and the water heater is generally positioned between the brackets. The first section of each bracket is connected to an inner or side face of the supporting member, with a second section of each bracket connected to an end face or front face of the supporting member. A strap is then connected to each of the brackets and the ends of the straps are then positioned around the water heater. A connector joins the ends of the straps around the water heater to restrain the water heater.

Other features and advantages of the invention will become apparent to those skilled in the art upon review of the following figures, detailed description of preferred embodiments and claims.

BRIEF DESCRIPTION OF THE DRAWINGS

These and other features of the invention will now be described with reference to the drawings of preferred embodiments, which are intended to illustrate and not to limit the invention, in which:

FIG. 11 is an exploded perspective view of a portion of still another embodiment of the present invention, illustrating a bracket mounted to a wall stud and extending through a hole in a wall covering, and illustrating an end of a water heater restraining strap for connection to the bracket;

FIG. 12 illustrates a top view of the bracket illustrated in FIG. 11 as connected to a wall stud and for connection to a restraining strap;

FIG. 13 is a top view of the bracket illustrated in FIG. 11;

FIG. 14 is a front view of the bracket illustrated in FIG. 11;

FIG. 15 is a side view of the bracket illustrated in FIG. 11;

DETAILED DESCRIPTION OF THE PREFERRED EMBODIMENT

Figure 1:
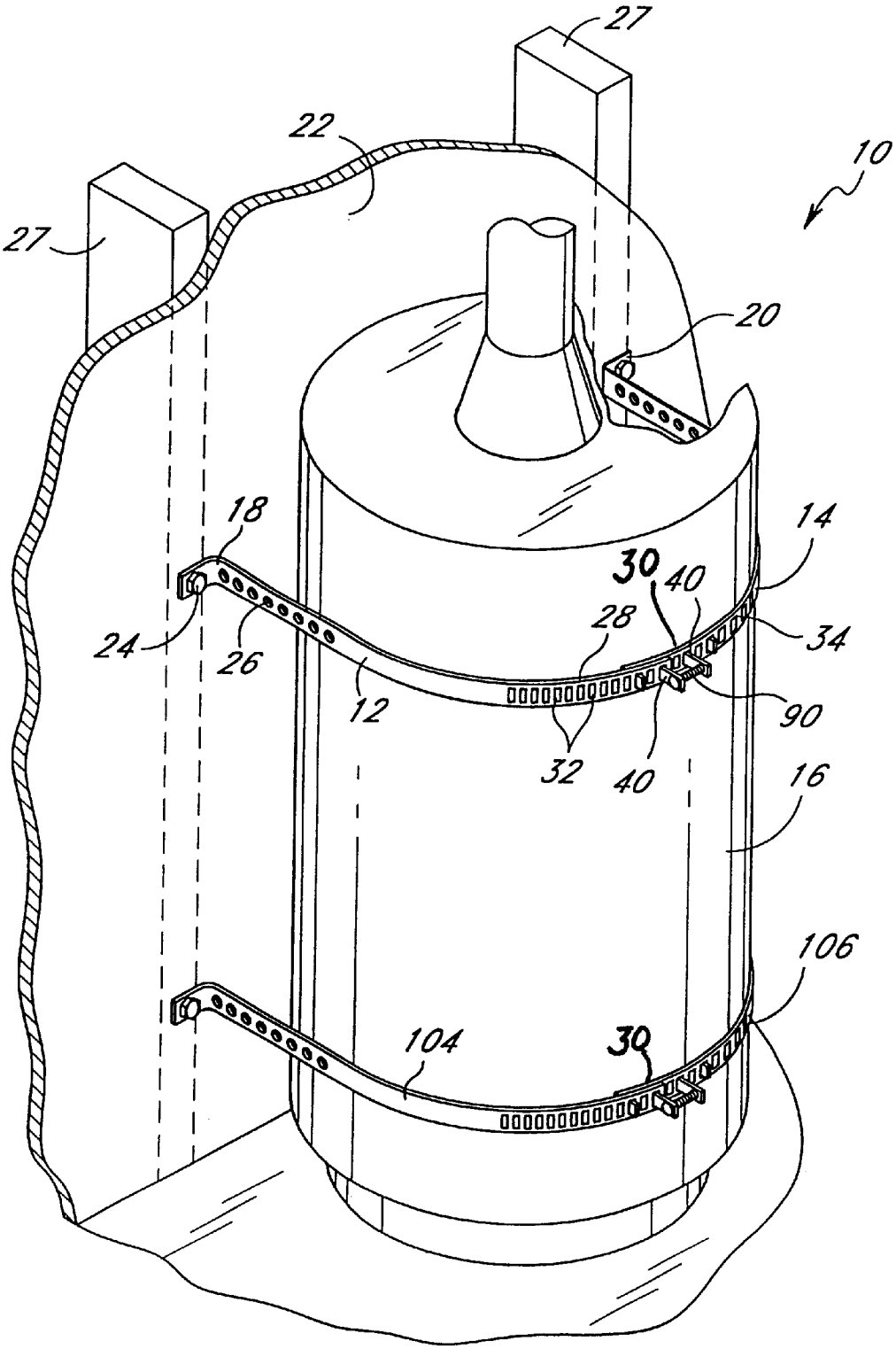
FIG. 1 is a perspective view of a preferred embodiment of the present invention.

Referring to FIG. 1, the water heater restraining system 10 includes two upper straps 12 and 14. The straps 12 and 14 extend around at least a portion of a water heater 16 mounted in a generally upright position. The water heater 16 shown in FIG. 1 is a conventional water heater with a generally cylindrical outer surface. It will be understood that the restraining system 10 can also be used to restrain or support water heaters of different configuration, and in other applications to restrain or support objects other than water heaters.

Each strap 12 and 14 has a first end 18 and 20, respectively, which is attached to a support structure 22. The support structure 22 is a generally rigid structure such as a wall or other upright support. As seen in FIG. 1, the first end 18 of the strap 12 is attached to the support structure 22 by a fastener 24. The fastener 24 includes any known method of fastening—such as nails, screws, threaded fasteners, bolts and glue, and various brackets. The first end 18 of the strap 12 includes one or more apertures 26 through which fastener 24 extends to make it easier to fasten the strap 12 to the support structure 22. Desirably, if the fastener 24 is connected to a support structure 22 comprising a wall, then the fastener 24 is attached to a stud 27. Similarly, the first end 20 of the strap 14 is also attached to the support structure 22 by a fastener in the same manner as end 18.

The straps 12 and 14 have a length which allows the first ends 18 and 20 to be fastened to the support structure 22 and second ends 28 and 30, respectively, to encircle the water heater 16, or to preferably encircle at least a sufficient portion of the water heater 16 such that the water heater 16 may be restrained. The straps 12 and 14 may be of equal or unequal length, as long as the combined length of the straps 12 and 14 is sufficient to encircle at least a portion of the water heater 16. Desirably the second ends 28 and 30 overlap to allow connection of the straps 12, 14 around the water heater 16. The length of the straps 12 and 14 may vary, for example, depending upon the size of the water heater, distance of the water heater from the support structure 22, or positioning of the water heater from the studs 27 in a supporting wall.

The straps 12 and 14 have a width and thickness sufficient to restrain the water heater 16 in an upright position. Desirably, the straps 12 and 14 have at least sufficient strength to support the water heater 16 during an earthquake. Preferably, the straps 12 and 14 are constructed from a metal such as steel or aluminum, and have a width of about 1.50 inches (3.80 cm) and a thickness of about 0.03 inches (0.076 cm). Other materials such as plastics or fabrics may also be used as long as the material provides sufficient strength to support the water heater 16 in the generally upright position under the load conditions required by the user.

The second ends 28, 30 of the straps 12, 14 include a plurality of holes that preferably comprise elongated slots 32 and 34, respectively. The slots 32 and 34 are desirably generally rectangular in configuration and the longer axis of the slots 32, 34 extends generally parallel to the width of the straps 12, 14. The slots 32, 34 are about 0.17 inches (0.43 cm) in width and about 0.85 inches (2.16 cm) in length. The slots 32, 34 can be also be larger or smaller in size, or different in shape. For example, the longer axis of the slot may extend generally perpendicular to the width of the strap and the slots may, for example, be circular, oblong or square. The plurality of slots 32, 34 are preferably spaced an equal distance apart. For example, the slots 32, 34 are preferably spaced about 1 inch (2.54 cm) apart. The slots 32, 34 may also be spaced closer together or farther apart, provided the slots 32, 34 are equally spaced. The slots may also be placed in adjacent rows with two or more slots positioned between the opposing edges of the strap. These slots advantageously have a generally constant distance separating the slots and a generally constant distance between the slots and the edge of the strap.

Figure 2:
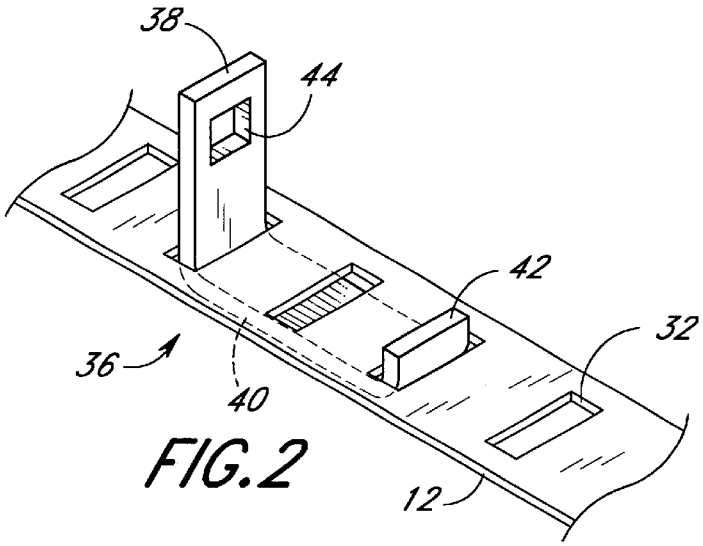
FIG. 2 is an enlarged, perspective view of a portion of the embodiment shown in FIG. 1, illustrating the connector.

As seen in FIGS. 1 and 2, the water heater restraining system 10 includes a clip or connector 36. As described below, the connector 36 is used to secure the straps 12, 14 about the water heater 16. The connector 36 includes a first end 38, a body 40 and a second end 42. The first end 38 and second end 42 are generally rectangular in configuration and extend in the same direction at about a 90° angle relative to the body 40 of the connector 36. The first end 38 preferably has a length greater than the length of second end 42, and the first end 38 includes an aperture 44. In particular, the first end 38 is about 1.50 inches (3.80 cm) in length, while the second end 42 is about 0.50 inches (1.27 cm) in length. The first and second ends 38, 42 can also be longer or shorter, but the ends 38, 42 have a length sufficient to extend through the slots 32, 34 respectively and to perform the functions described below.

The body 40 of the connector 36 is generally rectangular in shape and has a length approximately equal to the distance separating the one or more slots 32, 34. For example, the body 40 may have a width of about 0.75 inches (1.91 cm) and a length which is generally equal to the distance between adjacent slots so that the distance between the ends 38 and 42 of the connector 36 generally corresponds to the distance between the adjacent slots. More preferably, the body 40 has a length such that the distance between the center portion of the ends 38 and 42 of the connector 36 is generally equal to the distance between the center portions of the adjacent slots. Thus, in this example, the connector 36 is preferably about 1.00 inches (2.54 cm) in length between the center portion of end 38 and the center portion of end 42. The connector body 40 may also have a length that is a multiple of the distance separating the adjacent slots. Desirably, the body 40 has a length that is twice the distance separating the slots. In the preferred embodiment, the body 40 is about 2.00 inches (5.08 cm) in length between the center portion of end 38 and the center portion of end 42.

The width and thickness of the first and second ends 38, 42 of the connector 36 are sized smaller than the corresponding size of the slots 32, 34 in the straps 12, 14 to allow the first and second ends to be inserted through the slots. The first and second ends 38, 42 of the connector 36 can be readily inserted into the corresponding slots 32, 34 because the length of the body 40 is a multiple of the distance between the slots. Desirably, the slots 32, 34 and the ends 38, 42 have corresponding shapes and sizes to minimize the size of the slots in the straps 12, 14. Advantageously, this increases the strength of the straps. Additionally, the width and thickness of the ends 38, 42 are configured to fill almost the entire slot to increase the strength of the connector 36.

Figure 3:
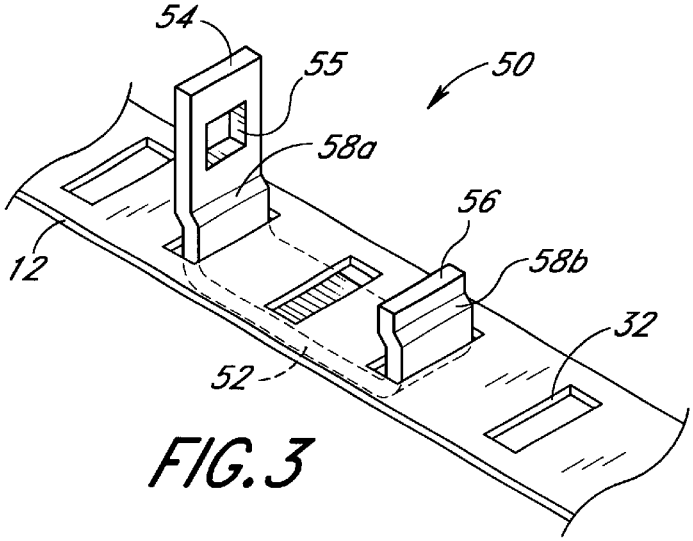
FIG. 3 is a perspective view of another embodiment of the connector shown in FIG. 2.

Another embodiment of a connector 50 is seen in FIG. 3. In this embodiment, the connector 50 includes a body 52, a first end 54 containing an aperture 55, and a second end 56. The first and second ends 54 and 56 also include angled sections 58*a* and 58*b*, respectively. The angled sections 58*a* and 58*b* extend preferably at about a 45° angle relative to the length of the first and second ends 54 and 56 or the body 52, and the angled sections are about the same distance from the body 52. The angled sections offset the free ends of ends 54, 56 from the generally perpendicular connection of the ends 54, 56 with the body 52. The angled sections 58*a* and 58*b* advantageously assist in keeping the connector 50 within the slots 32, 34 of the straps 12, 14 respectively. As seen in FIG. 3, the distance between ends 54, 56 is twice the distance between the slots 32 in the strap 12.

Figure 4:
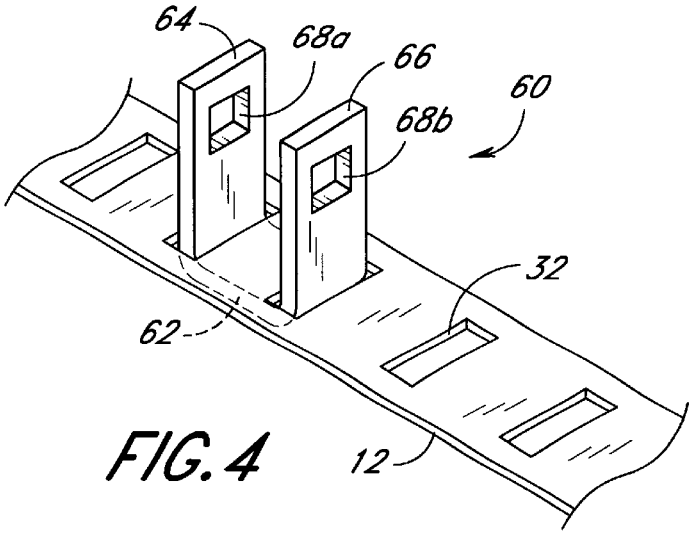
FIG. 4 is a perspective view of yet another embodiment of the connector shown in FIG. 2.

As seen in FIG. 4, another embodiment of a connector 60 includes a body 62, a first end 64 and a second end 66 generally perpendicular to body 62 and straps 12 or 14. The first and second ends 64 and 66 are about the same length to form a generally U-shaped connector that may be formed by bending a flat strap of material in a U-shape. Both the first and second ends 64, 66 contain an aperture 68*a* and 68*b* respectively, but a single aperture in the first end 64 may also be used. As seen in FIG. 4, the length of the body 62 is generally equal to the distance between two adjacent slots 32 in the strap 12.

Figure 5A:
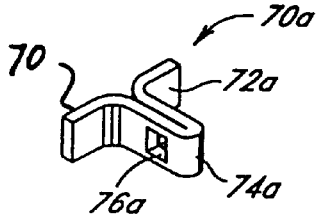
FIG. 5A is a respective view of still another embodiment of the connector shown in FIG. 2.
Figure 5B:
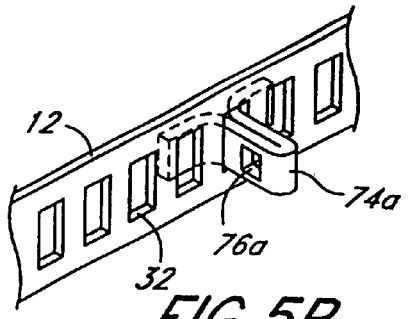
FIG. 5B is a perspective view of the connector shown in FIG. 5A, illustrating the connector inserted through a slot in a strap.

Other examples of connectors that may be used with the water heater restraining system 10 are shown in FIGS. 5A–5H, generally denoted as connector 70 and with various versions denoted as 70*a*–70*h*, but it will be appreciated that other types of connectors may also be used in view of the present disclosure. As seen in FIG. 5A, connector 70*a* includes a generally rectangular base 72*a* and a generally rectangular projection 74*a* with an aperture 76*a*. The projection 74*a* is perpendicular to the base 72*a*, and preferably positioned near the middle of the base 72*a*. The projection 74*a* is configured to fit through the slots 32, 34 in the straps 12, 14. The base 72*a*, however, is sized to prevent the connector 70*a* from being pulled through the slots 32, 34. For example, the base 72*a* may be wider and/or longer than the slot. As shown in FIGS. 5A and 5B, the projection 74*a* and the slots 32 are generally rectangular in configuration. Advantageously, when the projection 74*a* is inserted through a single slot 32 in the strap 12, the connector 70*a* provides more localized bending of the strap 12 than the previously described connectors because each connector 70*a* extends through only one slot 32, instead of extending through two slots in the embodiments described above. Because the connector 70*a* extends through only one slot 32, the slots can have any desired spacing between adjacent slots, and the spacing need not be uniform. Additionally, the connector 70*a* may be simpler and easier to make than the previously described embodiments because it may be formed by bending a single strip of metal.

Figure 5C:
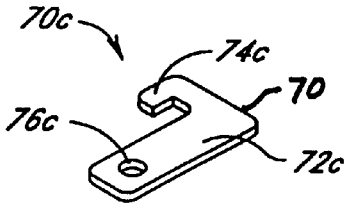
FIG. 5C is a perspective view of still another embodiment of the connector shown in FIG. 2.
Figure 5D:
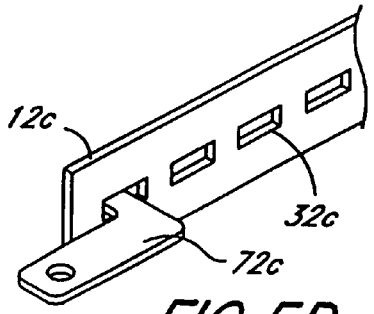
FIG. 5D is a perspective view of the connector shown in FIG. 5C, illustrating the connector inserted through a slot in a strap.

As shown in FIGS. 5C and 5D, the connector 70*c* includes a body 72*c* with a hook portion 74*c* at one end and an aperture 76*c* at the other end. The hook portion 74*c* is configured to fit through slots 32*c* in the strap 12*c*. In this embodiment, the longer axis of the slot 32*c* extends generally perpendicular to the width of the strap 12*c*. Of course, the slots 32*c* and hook portions 74*c* may have a variety of shapes and configurations. Advantageously, the connector 70*c* can be stamped from a piece of sheet metal and no bending or shaping of the connector is required.

Figure 5E:
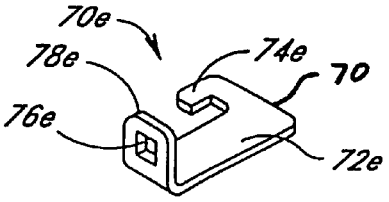
FIG. 5E is a perspective view of still another embodiment of the connector shown in FIG. 2.
Figure 5F:
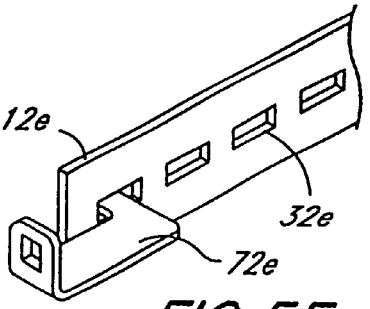
FIG. 5F is a perspective view of the connector shown in FIG. 5E, illustrating the connector inserted through a slot in a strap.

Another embodiment of the connector 70 is shown in FIGS. 5E and 5F. This connector 70*e* includes a body 72*e* with a hook portion 74*e* at one end and an aperture 76*e* at the other end. The aperture 76*e* is located in a bent portion 78*e* which is at an angle of about 90° with respect to the body 72*e*. As shown in FIG. 5E, the hook portion 74*e* is configured to fit through one of the slots 32*e* in the strap 12.

Figure 5G:
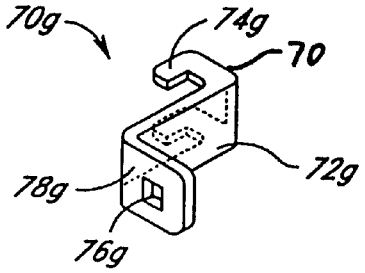
FIG. 5G is a perspective view of still another embodiment of the connector shown in FIG. 2.
Figure 5H:
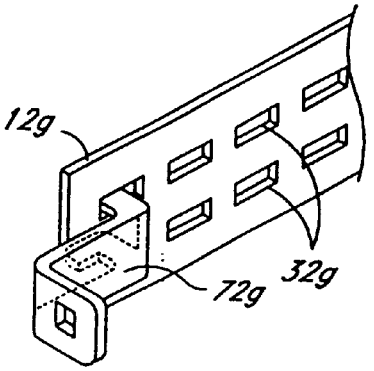
FIG. 5H is a perspective view of the connector shown in FIG. 5G, illustrating the connector inserted through a slot in a strap.

As shown in FIGS. 5G and 5H, the connector 70*g* includes a body 72*g* with a pair of hook portions 74*g* at one end configured to engage a pair of slots 32*g* in the strap 12*g*. The other end of the connector 70*g* includes an aperture 76*g* in an angled or bent portion 78*g*. The bent portion 78*g* is preferably at an angle of about 90° with respect to the body 72*g* of the connector 70*g*. Although not shown, the bent portion 78*g* may be supported by one or more gussets. The embodiment of FIGS. 5G and 5H can advantageously be stamped out of sheet metal and bent into shape, with a hole 76*g* punched into one end, and a U-shaped slot cut into an opposing end of the strip so that two 90° bends can form the hook portions 74*g*.

Figure 6A:
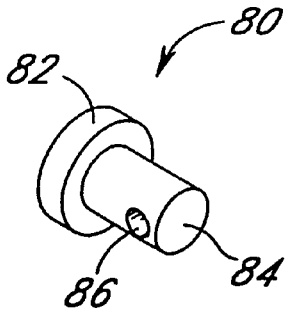
FIG. 6A is a perspective view of a further embodiment of the connector shown in FIG. 2.
Figure 6B:
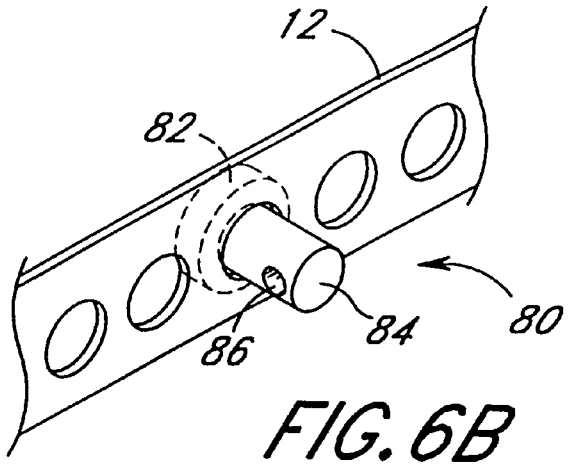
FIG. 6B is a perspective view of the connector shown in FIG. 6A, illustrating the connector inserted through a slot in a strap.

Another embodiment of a connector 80 is shown in FIGS. 6A and 6B. As seen in FIG. 6A, the connector 80 has a generally circular, disk-like base 82. From the center of the base 82 extends a generally cylindrical projection 84 and an aperture 86 extends through the projection 84. The projection 84 is configured to fit though one of the generally circular plurality of apertures 88 in the strap 12. The base 82 is sized to prevent the connector 80 from being pulled through the apertures 88. The base 82 may be cold headed on the end of cylindrical projection 84. It will be appreciated that various shapes and sizes of connectors, projections and corresponding apertures in the straps 12, 14 may be used in view of the present disclosure.

Figure 7:
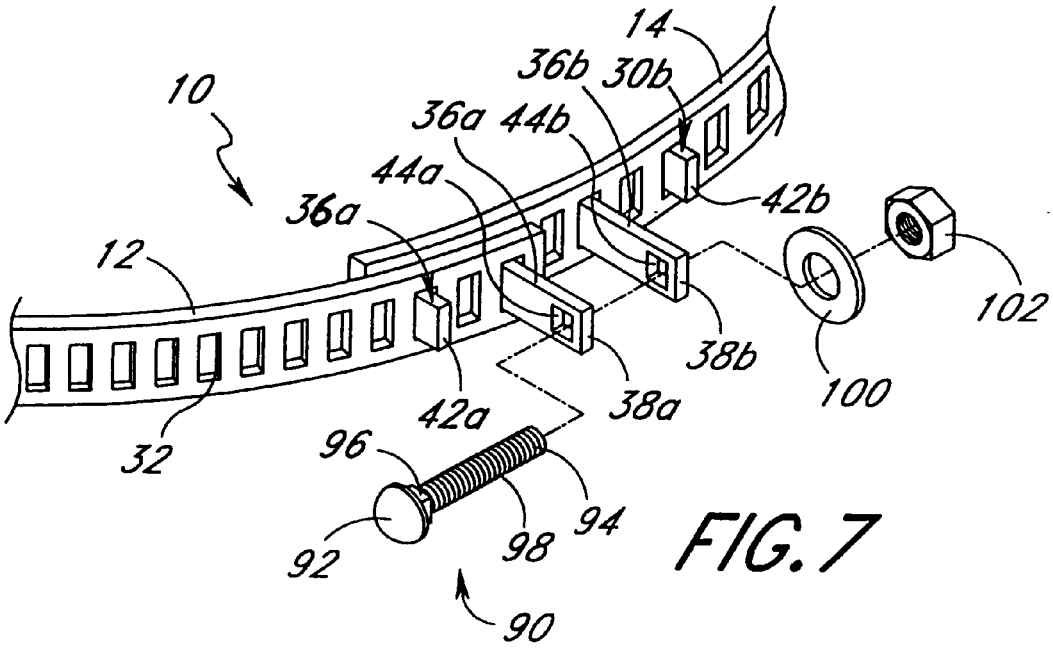
FIG. 7 is an exploded perspective view of a portion of the embodiment shown in FIG. 1 illustrating the adjustable fastener.

As shown in FIG. 7, an adjustable fastener 90 is used to fasten together a pair of connectors 36, 50, 60, 70 or 80. The adjustable fastener 90 is preferably a carriage bolt having a head 92 and a shaft 94. The shaft 94 has a non-threaded portion 96 and a threaded portion 98. The pair of connectors fastened together by the fastener 90 may be any of the embodiments described above, or any combination of embodiments. For example, as shown in FIG. 7, the adjustable fastener 90 fastens together two connectors 36*a* and 36*b* by extending through the holes in ends 38*a*, 38*b* of connectors 30*a*, 30*b* with connector 30 inserted through the second end of strap 12, and connector 30*b* inserted through the free end of strap 14. In particular, the fastener 90 extends through axially aligned apertures 44*a* and 44*b* in the first end 38*a*, 38*b* of the connectors 36*a*, 36*b*. A washer 100 is placed on the threaded portion 98 of the shaft 94 and a nut 102 is then threadably connected to the fastener 90. Desirably, the non-threaded portion 96 and the apertures 44*a*, 44*b* are generally square, with the non-threaded portion 96 configured to fit securely within either aperture 44*a* or 44*b* to restrain rotation of the fastener 90. Thus, the fastener 90 does not rotate while the nut 102 is being tightened. As seen in FIGS. 1 and 7, when the fastener 90 is tightened, the connectors 36*a* and 36*b* are pulled towards each other and this tightens the straps 12, 14 around the water heater 16.

In use, the first ends 18, 20 of the straps 12, 14 are connected to the support structure 22, for example, by fasteners 24. The straps 12, 14 are then positioned about the upper portion of the water heater 16 such that the second ends 28, 30 of the straps 12, 14 at least partially overlap. Alternatively, the ends 28, 30 of the straps 12, 14 may be positioned proximate to each other, but such that the straps do not overlap.

Any of the connectors 36, 50, 60, 70 or 80 described above, or combination thereof, may be used to fasten the straps 12, 14 together. For example, using connectors 36*a* and 36*b*, the first and second ends 38*a* and 42*a* of the first connector 36*a* are inserted through selected slots 32 in the strap 12. The connector 36*a* is positioned proximate the second end 28 of the strap 12. Preferably, the connector 36*a* is positioned one slot 32 from the second end 28 of the strap 12. The connector 36*a* may also be positioned in the last slot, or a greater number of slots from the end of the strap 12. The strap 12 may be cut, trimmed or bent to the desired length such that the connector 36*a* is placed proximate the end of the strap 12. Additionally, the connector 36*a* is inserted into the slots 32 with the first or longer end 38*a* closer to the second end 28 of the strap 12. A second connector 36*b* is inserted in a similar manner through the slots 34 in the strap 14. As described below, the connectors 36*a* and 36*b* are placed in slots 32 and 34 respectively to provide coarse adjustment of the straps 12, 14 about the water heater 16 to position the connectors 36 sufficiently close so that the fastener 90 can connect them and draw them together to tighten the straps.

The adjustable fastener 90 is inserted through the axially aligned apertures 44*a* and 44*b* of the connectors 36*a* and 36*b* respectively. The washer 100 and nut 102 are then inserted onto the end of the shaft 94 of the fastener 90. The nut 102 is then tightened to bring the connectors 36*a* and 36*b* closer together. This tightens the straps 12, 14 around the water heater 16 and provides fine adjustment of the restraining system 10. By analogy, the fastener 90 may be inserted through the apertures 55, 68, 76, 86 of the alternative embodiments of the connectors. In all embodiments except the embodiment of FIGS. 5C and 5D, the connectors have holes that are axially aligned with the longitudinal axis of the adjustable fastener 90 so the fastener can be inserted straight through the holes. In the embodiment of FIGS. 5C and 5D, the hole 76*c* is not axially aligned with the longitudinal axis of the adjustable fastener 90, and in that embodiment a fastener 90 with a J-hook end or a projection orthogonal to the longitudinal axis of the fastener 90 can be used to engage the aperture 76*c*.

Advantageously, the restraining system 10 allows the straps 12, 14 to be quickly and efficiently adjusted to the proper length. This allows the water heater 16 to be positioned at various distances from the support structure 22 and various sizes of water heaters 16 to be restrained by the restraining system 10. In particular, the length of the straps 12, 14 are coarsely adjusted by positioning the connectors 36*a*, 36*b* in the desired slots 32, 34. If one or both of the straps 12, 14 are too long, one or both of the straps may be cut or folded to allow the correct positioning of the connectors. After the connectors 36*a*, 36*b* are positioned in the desired slots, the adjustable fastener 90 is inserted through the aligned apertures 44*a*, 44*b* and the nut 102 is tightened to provide fine adjustment of the straps 12, 14 about the water heater 16. Thus, the system 10 quickly and easily allows the straps 12, 14 to be securely fastened around the water heater 16.

Alternatively, instead of using a pair of connectors 36, 50, 60, 70 or 80 described above, a single connector can be used to connect the straps 12 and 14. For example, a connector 36, 50, 60, 70 or 80 is inserted through a selected slot 32 in the strap 12. An adjustable fastener, such as the carriage bolt described above, is inserted through a desired slot 34 or other-shaped opening in the strap 14. Preferably the strap 14 is bent at about a 90° angle proximate the selected slot 34 such that the adjustable fastener is generally aligned with the aperture in the connector. The straps 12 and 14 may be cut, trimmed or bent to the desired length such that the connector and fastener are placed proximate to each other. The fastener, which extends through the slot 34 and aperture in the connector, is then tightened to tighten the straps 12 and 14 about the water heater 16. Of course, the connector 36, 50, 60, 70 or 80 may be inserted through a selected slot 34 in the strap 14 and an adjustable fastener may be inserted through a slot 32 or other-shaped opening in the strap 12.

The straps 12, 14 are desirably positioned towards the upper section of the water heater 16. Advantageously, a second set of straps 104 and 106 (FIG. 1), with associated connectors and adjustable fasteners as described above, are positioned towards the lower section of the water heater 16. A single pair of straps may be used, or more than two pairs of straps may be used to restrain the water heater 16.

Figure 8:
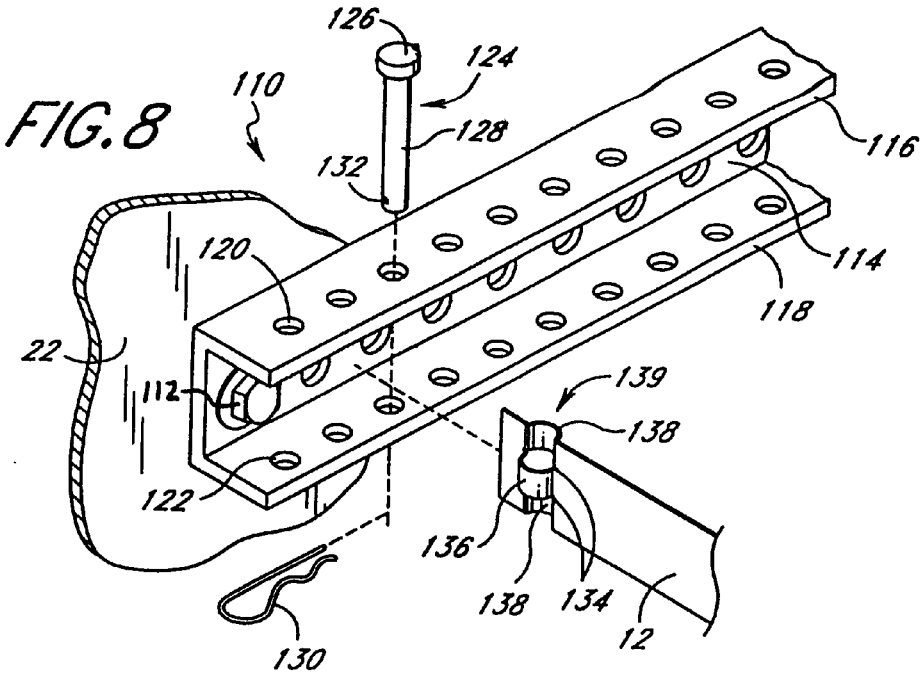
FIG. 8 is an exploded perspective view of a portion of another embodiment of the present invention, illustrating a bracket and an alternative method of securing the strap to the wall structure via the bracket.

As seen in FIG. 8, the first end 18 of the strap 12 may be connected to a bracket 110. The bracket 110 is connected by one or more fasteners 112 (FIG. 9) to the support structure 22, and preferably to at least one stud 27. The fasteners 112 may include any known means for attaching the bracket 110 to the support structure 22, such as threaded fasteners, bolts, screws, and the like. The bracket 110 is a "C" channel in cross-section which includes a body 114, an upper extension 116 and a lower extension 118. The bracket 110 is attached to the support structure 22 such that the body 114 abuts the support structure 22. The extensions 116 and 118 extend from the body 114 in the same direction and at about a 90° angle from the body 114 of the bracket 110. The extensions 116, 118 include a series of apertures 120 and 122, respectively. The series of apertures 120 and 122 are aligned to allow a fastener 124 to be inserted through adjacent apertures. The fastener 124 desirably is a pin or bolt with a head 126 and a shaft 128. The shaft 128 is configured to fit through the aligned apertures 120, 122. The fastener 124 may be secured in position by a pin 130 which may be inserted through an opening 132 which extends through the shaft 128. The fastener 124 may also be secured in position by a cotter pin, threaded nut, snap ring, threaded fastener or the like. Similarly, the first end 20 of the strap 14 is connected to the same or similar bracket 118.

The first ends 18, 20 of the straps 12, 14 are configured to receive the fastener 124 such that the straps are securely connected to the bracket 110. As shown in FIG. 8, the first end 18 of the strap 12 includes two substantially parallel slots 134 which are generally parallel to the length of the strap. The slots 134 are separated by an area 136 which is bent in a first direction generally orthogonal to the strap 12. The area 136 is preferably semi-circular in configuration and has a radius of curvature slightly larger than the fastener 124. The areas 138 between each of the slots 134 and the adjacent edges of the strap 12 are bent in a second direction opposite the first direction. The areas 138 are preferably semi-circular in configuration and have a radius of curvature slightly larger than the fastener 124. Advantageously, the areas 136 and 138 form a generally circular opening 139 in a direction substantially perpendicular to the length of the strap 12. Thus, the areas 136 and 138 cooperate to allow the fastener 124 to pass transverse to the length of the strap 12.

In use, the bracket 110 is attached to the support structure 22 by one or more fasteners 112. The opening 139 in the first end 18 of the strap 12 is aligned with the desired apertures 120, 122 in the upper and lower extensions 116, 118 of the bracket 110. The fastener 124 is inserted through the apertures 120, 122 and opening 139 to connect the strap 12 to the bracket 110. The fastener 124 is releasably secured in position by the pin 130 inserted through the opening 132 in the shaft 128. The pin 130 prevents the unintended the removal of the fastener 124. The first end 20 of the second strap 14 is connected in a similar manner to the bracket 110. There is advantageously provided a bracket that fastens to the wall 22, with the bracket having means for connecting a strap 12, 14 to the bracket.

Figure 9:
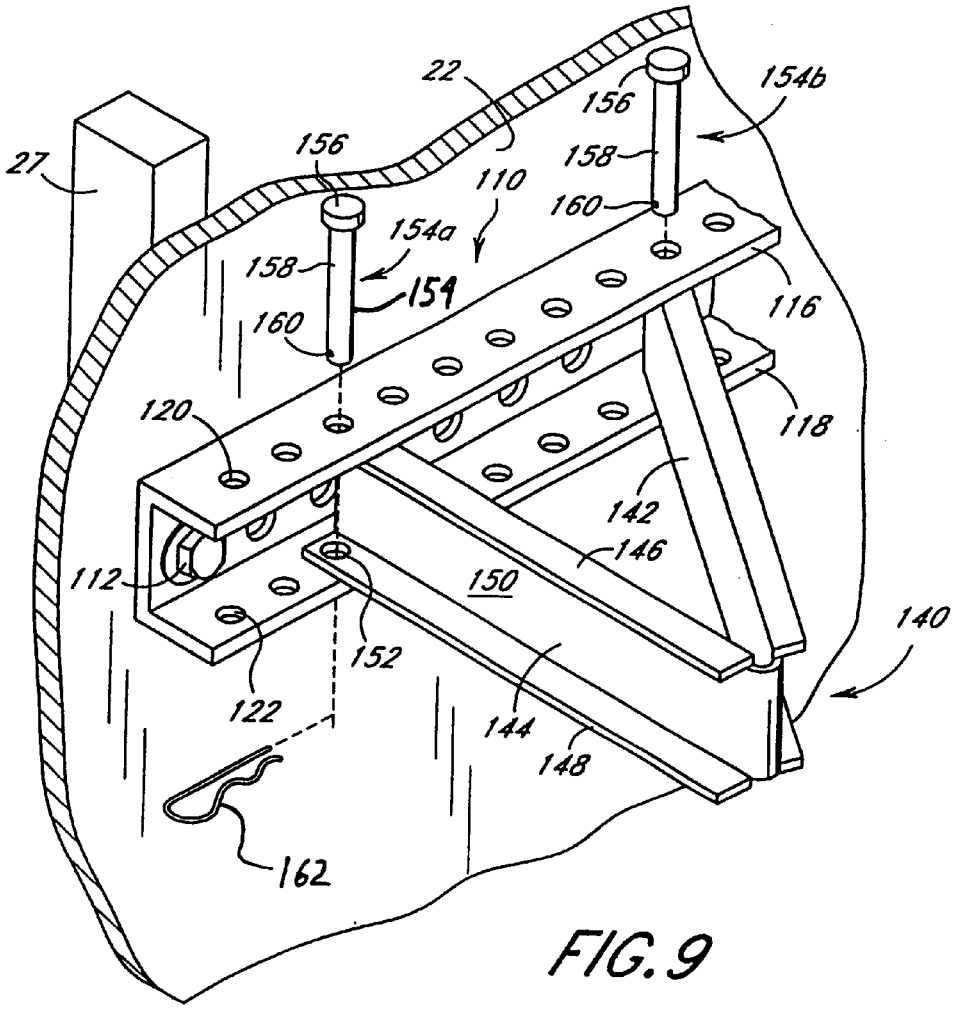
FIG. 9 is an enlarged, perspective view of a portion of yet another embodiment of the present invention, illustrating a bracket and a wedge.

As seen in FIG. 9, the restraining system 10 may also include one or more holding brackets or wedges 140 connected to the bracket 110. The wedge 140 has a V-shaped body with legs 142 and 144. Each leg 142, 144 has an upper extension or flange 146, a lower extension or flange 148 and a central body section 150 joining the flanges. The upper and lower extensions 146, 148 extend generally in the same direction and at about a 90° angle from the central body 150. The distal ends of the wedge 140 includes apertures 152 in the upper and lower extensions 146, 148. The apertures 152 are configured to receive fasteners generally denoted as fasteners 154, and illustrated as fasteners 154*a*, 154*b* so that the wedge 140 is connected to the bracket 110 in a manner similar to that described above. The fasteners 154 include a head 156, a shaft 158 and an aperture 160. The aperture 160 is configured to receive a pin 130 such as a cotter pin, threaded nut, snap ring or the like to prevent the unintended removal of the fastener 154.

The wedge 140 has a V-shape in part so that one leg 142 can be positioned proximate or adjacent one side of the water heater 16. Desirably, the wedge 140 assists in placing the water heater 16 in the desired position and limits the movement of the water heater 16. Advantageously, the leg 142 of the V-shaped wedge 140 adjacent the water heater 16 can be curved to increase the area that may contact the water heater 16. Preferably, the water heater 16 abuts the leg 142, and the portion of leg 142 abutting the water heater 16 is configured to have an engaging surface that does not puncture or damage the water heater 16. For example, if the leg 142 is formed by cutting the upper and lower extensions 146, 148 of the wedge 140 and bending the wedge at the cut, as shown in FIG. 9, the upper and lower extensions 146, 148 preferably have sufficient thickness to avoid damaging the water heater 16. Although not shown in the accompanying figures, a plate can be fastened to the leg 142 to increase the area of the wedge engaging the water heater 16. In addition, a resilient material or other flexible member may be interposed between the leg 142 and the water heater 16 to reduce damage to the water heater 16 during installation and during motion that may occur during earthquakes. For example, the leg 142, or a portion thereof, could be coated with a plastic or rubber material. The legs 142, 144 could also be bent in the opposite direction from that shown in FIG. 9 so that upper and lower extensions 146, 148 were not oriented outward to engage the water heater 16. Instead, the body 150 of the wedge 140 would engage the water heater 16.

Preferably, two wedges 140 are located on opposing sides of the water heater 16. The construction of the second wedge is similar to the wedge described above and will not be repeated. The second wedge may be fastened to the same bracket 110 as the first wedge, or the second wedge may be fastened to a different bracket. Advantageously, as described in greater detail below, the wedges 140 may be used independently or in conjunction with the straps 12, 14.

In operation, the bracket 110 is attached to the supporting surface 22 by one or more fasteners 112. The ends of the wedge 140, which are configured to fit between the upper and lower extensions 116 and 118 of the bracket 110, are attached to the bracket 110 by fasteners 154*a* and 154*b*. In particular, openings 152 in the legs 142 and 144 are aligned with selected apertures 120, 122 in the upper and lower extensions 116, 118 of the bracket 110. The fasteners 154*a* and 154*b* are inserted through the apertures 120, 122 and 152 to connect the wedge 140 to the bracket 110. The fastener 154*a* and 154*b* are releasably secured in position by the pin 130 inserted through the aperture 160 extending through the shaft of 158 of the fasteners 154*a* and 154*b*.

Figure 10:
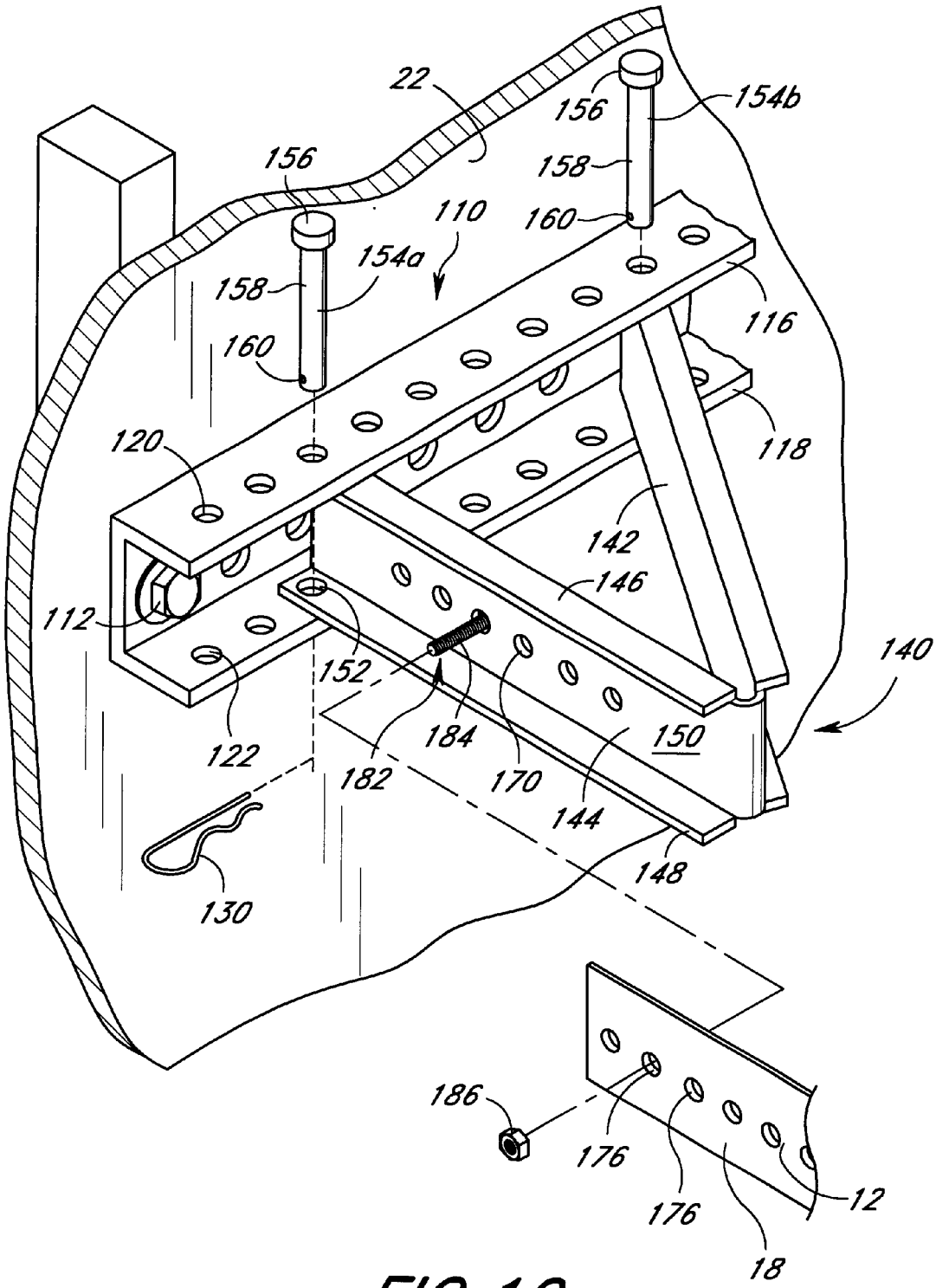
FIG. 10 is a perspective view of a portion of still another embodiment of the present invention, illustrating a bracket, a wedge and a strap.

In yet another embodiment of this invention, as shown in FIG. 10, the leg 144 of the wedge 140 has a plurality of round holes 170 located along its axis. The first end 18 of the strap 12 includes a plurality of round holes 176 located along the axis of the strap 12, of a size and shape similar to the holes 170 in the leg 144 of wedge 140. Of course, the holes 170 and 176 may have any desired shape or configuration, and any number of holes may be used depending upon the desired configuration of the restraining system.

The strap 12 is releasably secured to the wedge 140 by the use of a fastener 182. In particular, the fastener 182 is inserted through the selected hole 170 in the leg 144 and the selected hole 176 in the strap 12. The fastener 182 preferably comprises a threaded shaft 184 and a nut 186, but other threaded fasteners and removable fasteners could be used. The threaded fastener 182 allows the strap 12 to be securely connected to the wedge 140. The strap 14 on the other side of the water heater 16 may be connected to a bracket 110 or wedge 140 on the other side of the water heater 16 in any manner described above.

As seen in FIGS. 11–19, the restraining system 10 may also include a Z-shaped bracket 220 which can be connected to one or more straps which extend around the water heater. In particular, as best seen in FIGS. 11–16, the Z-shaped bracket 220 has three main sections: (1) a first section 226 for extension along the side of a wall stud 250; (2) a second section 228 which extends generally perpendicular to the first section for extension along the front face of the wall stud; and (3) an attachment section 230 which extends generally perpendicular to the second section (and parallel to the first section). The attachment section 230 extends outwardly from the wall stud 250 for attachment of the securing strap 212. There is thus advantageously provided two generally parallel sections 226 and 230 extending in opposing directions from the offset, second section 228.

As best seen in FIGS. 13–15, the bracket 220 has a Z-shaped configuration with the first section 226 having a length of about 1 inch, and the attachment section 230 having a length of about 2.5 inches so that the total length of the bracket 220 is about 3.5 inches. The bracket 220 preferably has a height of about 1.5 inches, and is constructed of 14 gauge galvanized steel. The length of the second section 228 is about 1.6 inches. It will be appreciated that the bracket 220 may also be larger or smaller, and it may be constructed from a wide range of materials having the desired strength.

As seen in FIG. 14, the bracket 220 has a hole or bore 234 positioned in the second section 228. The bore 234 is desirably centered in this second section 228 of the bracket 220, as illustrated in FIG. 14. It will be appreciated that the bore 234 may be positioned in any desired location on location 228. As seen in FIG. 15, another hole or bore 236 is positioned in the attachment section 230 of the bracket 220. This bore 236 is located approximately 1.5 inches along the attachment section 230 from the second section 228, and midway along the height of the bracket 220. This bore 236 preferably has a diameter of about 0.28 inches, slightly larger than a quarter inch diameter fastener which may extend through the bore. Additionally, two holes or bores 238 and 240 are positioned in the first section 226. These bores 238 and 240 are centered on the bracket 220, and midway along the length of the first section 226 (i.e. about 0.5 inches in from the second section 228). Desirably, the edge 242 of the attachment section 230 opposite the second section 228 has angled portions 244 and 246, which are located at about 45° and are about 0.5 inches in length. Of course, the angled portions may have any desired shape or configuration, including rounded or square. Further, it will be understood that the bracket may have any desired dimensions depending upon the particular use of the bracket 220.

Figure 16:
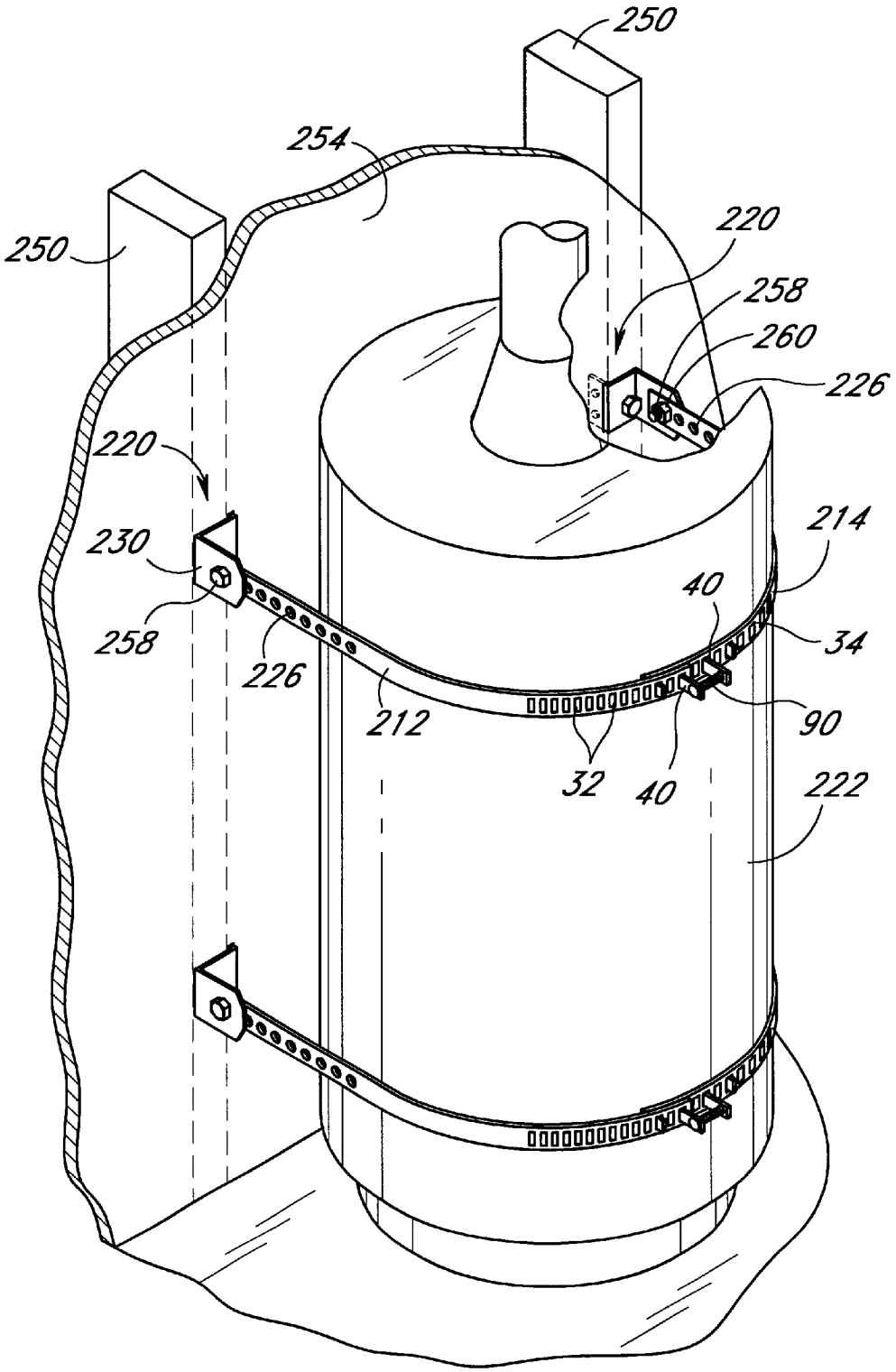
FIG. 16 is a perspective view illustrating a pair of brackets mounted to wall studs, each bracket having a portion extending through a hole in a wall covering connected to the studs, and including a strap extending around a water heater and attached to the brackets.
Figure 17:
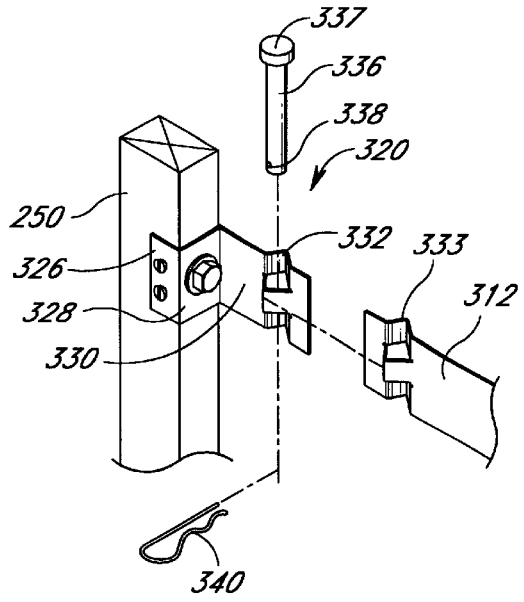
FIG. 17 illustrates an alternate embodiment bracket in accordance with the present invention, the bracket including a sliding pin type mounting arrangement for a water heater restraining strap.
Figure 18A:
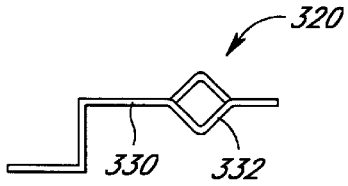
FIG. 18A illustrates a top view of the bracket illustrated in FIG. 17.
Figure 18B:
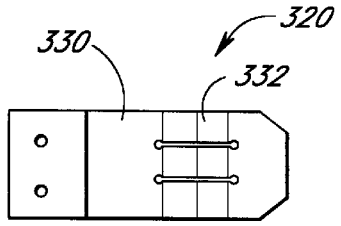
FIG. 18B illustrates a side view of the bracket illustrated in FIG. 17.

Mounting of one or more brackets 220 and its method of use in restraining a water heater 222 is best illustrated in FIGS. 11, 12 and 16. The bracket 220 is preferably connected to a wall stud 250 with the first section 226 extending along an inner side of the stud, the second section 228 extending along the front face of the stud, and the attachment section 230 extending outwardly from the stud. As illustrated in FIGS. 11 and 12, a lag bolt 252 or other type of fastener is passed through the bore 234 in the second section 228 of the bracket 220 into the front face of the stud 250. Optionally, a screw 251 or other type of known fastener may be passed through one or both of the bores 238 and 240 into the inner side of the stud 250 to attach the bracket 220 to the stud. The longitudinal axis of the fasteners 251 are generally perpendicular to the longitudinal axis of fastener 252, as are the portions of the bracket 220 through which the fasteners extend.

As seen in FIG. 16, when a water heater 222 is being restrained, two brackets 220 are preferably used, with each bracket connected to a stud 250 positioned on opposite sides of the water heater. As illustrated therein, the "inner" side of the stud 250 is that side of the stud which faces in the direction of the item being secured. Once each bracket 220 is in position, drywall or other wall covering 254 may be placed over the studs 250. When so installed, the attachment section 230 of the bracket 220 extends through a hole or slot 256 in the wall covering 254. In this manner, the remainder of the bracket 220 and its attachment to the stud 250 is hidden behind the wall covering 254. The slot 256 in the wall covering 254 through which the attachment section 230 of the bracket 220 extends may either be pre-formed, or may be formed by punching the bracket 220 through the wall covering. To facilitate punching the bracket 220 through the wall covering, the free end of the attachment section 230 of the bracket has angled sections 244 and 246 as shown in FIG. 15.

Once the brackets 220 are installed, a first water heater restraining strap 212 is connected to one bracket and a second water heater restraining strap 214 is connected to the other bracket. In particular, each end of the straps 212, 214 includes one or more through-holes 226, and the straps 212, 214 are attached to the attachment section 230 of the brackets 220 with a fastener, such as a bolt 258 threadably connected to a nut 260, but any type of fastener may also be used. Additionally, the first sections 226 of each bracket 220 may be fastened to the side of the stud 250 by fasteners 251, such as nails or screws. As shown in FIG. 16, the straps 212 or 214, which preferably comprise any of the embodiments previously described, are positioned around the water heater 222. The straps 212, 214 are preferably tightened around the water heater 222 using one or more of the embodiments described above. In the version illustrated in FIG. 16, the straps 212, 214 are connected by a pair of connectors 40 which are connected by an adjustable fastener 90.

One of the significant advantages of the bracket 220 of the present invention is that it is not mounted externally to the wall covering 254. Instead, the bracket 220 is directly attached to the stud 250, with only a small portion thereof protruding through the wall covering 254. This offers advantages for the installer, including making it unnecessary to "hunt" for the stud 250 after the wall covering 254 is installed.

Another advantage is that the fastener 252 is at right angles to fasteners 251, so that one fastener is placed in shear when forces are exerted on the attachment section 230—which provides a stronger connection with the stud 250. The arrangement also pulls one portion 226, 228 of the bracket into the stud 250 during many types of loading and thus also provides a stronger connection. The brackets 220 may be placed on either side of a stud 250, but are preferably fastened so that a load on the strap 212 pulls the bracket into the stud and places one or both fasteners 251, 252 in shear.

An alternate form of the bracket 320 is illustrated in FIGS. 17 and 18A–C. Bracket 320 is similar to that described above, except that the attachment section 330 of the bracket 320 includes an expanded diamond-shaped section 332 for acceptance of a similar section 333 on the end of the strap 312. In this manner, the strap 312 and bracket 320 may be connected to one another by a pin 336. Desirably the pin 336 has a head 337 at one end and an opening 338 at the other end. The pin 336 is configured to fit through the diamond-shaped section 332 and a clip 340 or other member may be inserted through the opening 338 to hold the pin in the desired location. In use, the diamond-shaped section 333 of the strap 312 engages the diamond-shaped portion 332 in the bracket 320 and the pin 336 is inserted through both diamond-shaped sections to attach the strap to the bracket.

Figure 19:
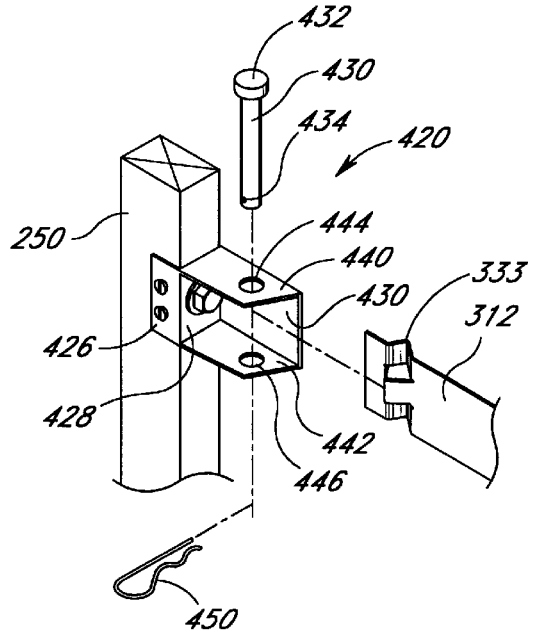
FIG. 19 illustrates yet another embodiment bracket in accordance with the present invention, the bracket having yet another structure for connection of a strap thereto with a pin.

Yet another form of the bracket 420 is illustrated in FIG. 19. In this figure, the bracket 420 includes a top flange 440 and bottom flange 442 which extend horizontally outward. The flanges 440 and 442 have aligned bores 444 and 446 respectively, for accepting a pin 430 with a head 432 and an aperture 434. A strap similar to that illustrated in FIG. 17 may be connected to the bracket 420 by extending the pin 430 through the bore 444 in the top flange 440 through the expanded diamond-shaped section 333 of the strap, and then through the bore 446 in the bottom flange 442. A clip 450 or other type of fastener may then be inserted through the opening 434 in the pin 430 to secure the pin in the desired position.

A wide variety of configurations are contemplated for the attachment sections 220, 320 and 420 for use in connecting a restraining strap thereto other than those illustrated and described. For example, the given dimensions and configurations are for use with 2 inch by 4 inch studs that are commonly used during construction. Other dimensions and configurations are suitable and could be devised given the enclosed information. For example, the length of the first section 226 could extend for varying distances along the stud it preferably abuts. Similarly, the middle or second section 228 could extend for only a portion of the width of the stud that it preferably abuts. Advantageously, the middle or second section 228 does not extend substantially beyond the adjacent stud 250. Preferably the second section 228 bends outward, away from the adjacent stud 250, at a location over the stud 42.

In further variations, the first portion 226 could extend for a predetermined distance along the length of the stud 250 to provide increased stability. Similarly, the second portion 228 could extend for a predetermined distance along the length of the stud 250, with fasteners at opposite ends of the elongated second portion 228, in order to provide increased stability. Further, the Z-shaped bracket 220 or the wedge shaped bracket 140 could be modified to contain a hole axially aligned to cooperate with fastener 90 and a connector 36, 50, 60, 70 or 80 connected to one strap 12, 14, 104, etc.

Figure 20:
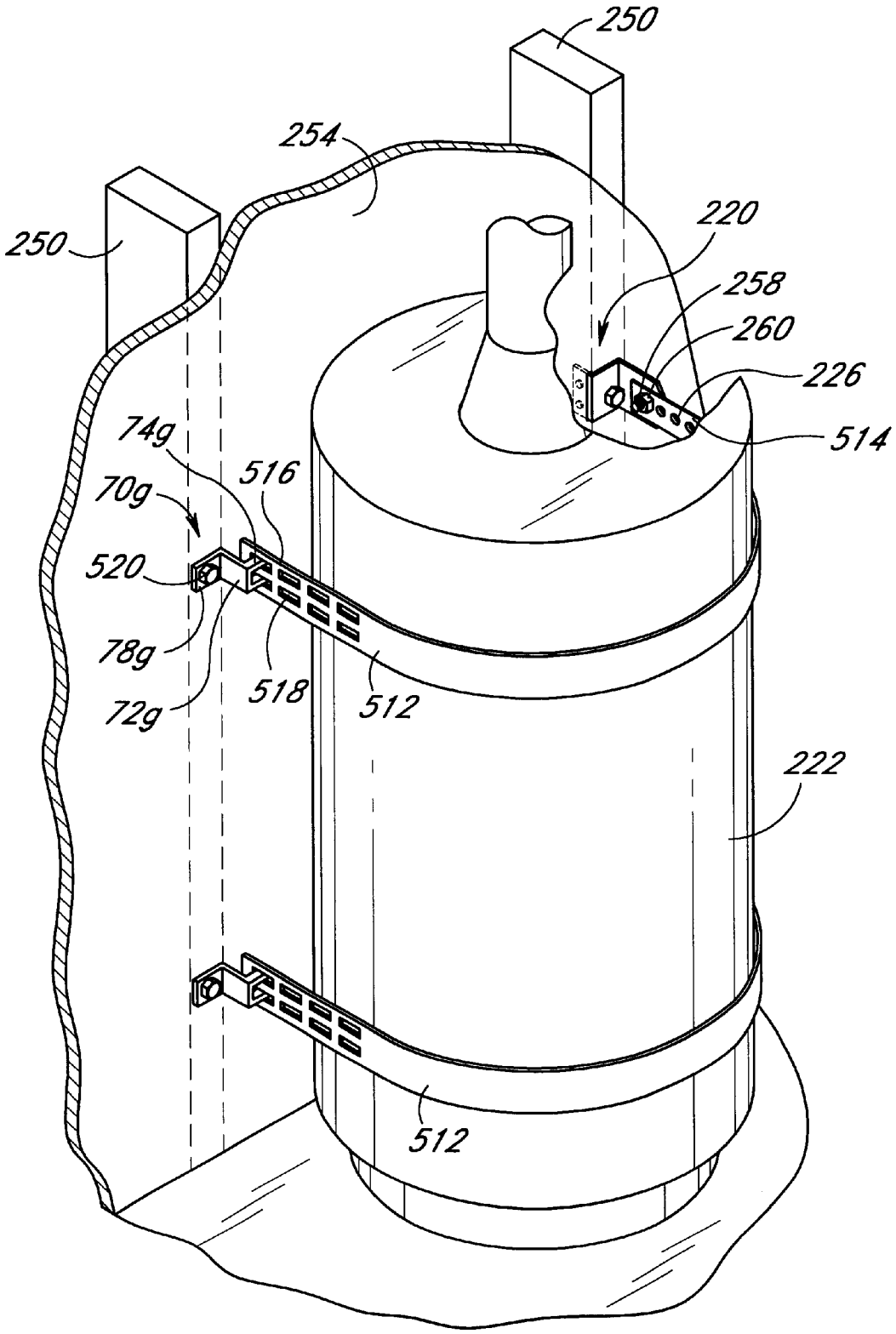
FIG. 20 is a perspective view of a preferred embodiment of the present invention.

It will be understood that a single strap 512 may also be used to restrain a component such as a water heater 222 in a desired upright position. For example, as shown in FIG. 20, the first end 514 of the strap 512 is connected to a bracket 220 by a fastener such as a bolt 258 and nut 260. The strap 512 extends around the water heater 222 and the second end 516 of the strap includes one or more apertures or openings 518. A connector is then inserted into the desired opening or openings, and the strap 512 is then cut, trimmed or bent such that the connector is located at the end of the strap. In particular, as shown in FIG. 20, connector 70*g* is used and is fastened to a stud 250 by a fastener 520 such as a screw. It will be appreciated that various types of connectors, such as connectors 36, 50, 60, 70 or 80 described above, may also be connected directly to the wall by threaded fastener, or connected to a bracket connected to the wall, in order to hold one end of a threaded fastener that can adjust the tightness of the strap.

The various components of the restraining system 10, such as the connectors, brackets and wedges, are preferably made of metal. Advantageously, these components are made of steel. Other types of metal, such as aluminum, may also be used to construct the restraining system 10. It is believed possible that non-metal materials, such as certain plastic compounds or fabrics, could be suitable for some or all of these components of the restraining system 10 provided the components satisfy the appropriate strength and durability requirements. Given the above disclosure, one skilled in the art can devise other ways of implementing the teaching of this disclosure to achieve the inherent advantages and features of this invention.

Additionally, this restraining system 10 is not limited to use with water heaters, but may be used with other objects such as water tanks, storage tanks, boilers, pressure vessels and other types of receptacles and storage chambers. It will be appreciated that the present invention can also be used with any item that may be restrained from movement by connecting to a support or a support surface.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A restraining system for securing a water heater to a support structure, comprising:

a first strap having a first end and a second end, said second end including a plurality of openings;

a first connector, said first connector selectively connectable to said first strap through at least one opening in said first strap;

a second strap having a first end and a second end, said second end including a plurality of openings;

a second connector, said second connector selectively connectable to said second strap through at least one opening in said second strap; and an adjustable fastener configured to connect said first connector and said second connector and change the length of the strap as the fastener moves the connectors relative to each other.

2. The restraining system of claim 1, wherein said first connector includes an extension configured to fit through one of said plurality of openings in said first strap, said extension including an aperture, wherein said second connector includes an extension configured to fit through one of said plurality of openings in said second strap, said extension including an aperture, and wherein said adjustable fastener is inserted through said aperture in said first connector and said aperture in said second connector to connect said first connector and said second connector.

3. The restraining system of claim 2, wherein said first connector includes a base, said base configured to prevent said first connector from being pulled through said openings in said first strap during use of said first connector, and wherein said second connector includes a base, said base configured to prevent said second connector from being pulled through said openings in said second strap during use of said second connector.

4. The restraining system of claim 1, wherein said first connector includes a first end, a central body and a second end, wherein said second connector includes a first end, a central body and a second end, and wherein said first end of said first connector and said second connector includes an aperture cooperating with the fastener to change the length of the straps, and said first end is greater in length than said second end.

5. The restraining system of claim 4, wherein a distance separating adjacent openings in said plurality of openings in said first strap and said plurality of openings in said second strap are separated by substantially the same distance.

6. The restraining system of claim 5, wherein said central body of said first connector and said central body of said second connector have generally the same length, said length of said central bodies is generally equal to said distance separating said plurality of openings.

7. The restraining system of claim 5, wherein said body of said first connector and said body of said second connector have generally the same length, said length of said bodies is generally a multiple of said distance separating said plurality of openings.

8. The restraining system of claim 1, wherein said first end of said first strap and said first end of said second strap are fastened to the support structure.

9. The restraining system of claim 1, further comprising a bracket, said bracket adapted to be connected to the support structure, and configured to be connected to the first end of one of the straps.

10. The restraining system of claim 9, wherein one of said first end of said first strap and said first end of said second strap is connected to said bracket and said bracket is connected to a wall.

11. The restraining system of claim 9, further comprising a wedge having a first leg and a second leg connected to the bracket, said first leg configured to restrain movement of the water heater.

12. The restraining system of claim 11, further comprising one or more openings in one of said legs of said wedge, said openings configured to be aligned with at least one of said openings in said first end of said first strap.

13. The restraining system of claim 12, wherein said first end of said first strap is fastened to said wedge.

14. The restraining system of claim 9, wherein the bracket comprises:

a first section;

a second section connected at a generally perpendicular angle to said first section;

a third section connected at a generally perpendicular angle to said second section and generally parallel to the first section, said third section configured to be attached to the strap.

15. The restraining system of claim 14, wherein at least one of the first and second sections have a hole therein sized to allow a fastener to be inserted through the hole to fasten the bracket to the support.

16. The restraining system of claim 1, wherein said plurality of openings in said first strap comprises a plurality of elongated slots, and wherein said plurality of openings in said second strap comprises a plurality of elongated slots.

17. The restraining system of claim 1, further comprising a bracket having a first section and a second section configured to be attached to the support structure.

18. The restraining system of claim 17, further comprising a third section attached to said second section and configured to be attached to the first end of one of said straps.

19. The restraining system of claim 1, wherein the first connector comprises at least one hook that extends through one of the openings in the first strap and extends along a side of the first strap opposite the first connector to hold the first connector to the first strap.

20. The restraining system of claim 19, wherein the second connector comprises at least one hook that extends through one of the openings in the second strap and extends along a side of the second strap opposite the second connector to hold the second connector to the second strap.

21. The restraining system of claim 1, wherein the first connector comprises a plurality of hooks that extend through the openings in the first strap and extend along a side of the first strap opposite the first connector to hold the first connector to the first strap.

22. The restraining system of claim 21, wherein the second connector comprises a plurality of hooks that extend through the openings in the second strap and extend along a side of the second strap opposite the second connector to hold the second connector to the second strap.

23. A restraining system for securing a water heater to a support structure, comprising:

a first strap having a first end adapted to be connected to the support structure, said first strap having a plurality of openings; a second strap having a first end adapted to be connected to the support structure, said second strap having a plurality of openings;

a first connector, said first connector including an extension configured to extend through a selected opening from said plurality of openings in said first strap and an enlarged portion configured to prevent passage of the enlarged portion and the entire first connector through said selected opening;

a second connector, said second connector including an extension configured to extend through a selected opening from said plurality openings in said second strap and an enlarged portion configured to prevent passage of the enlarged portion and the entire second connector through said selected opening; and an adjustable fastener, said adjustable fastener configured to connect said first connector to said second connector wherein said selected opening in said first strap and said selected opening in said second strap may be selected for coarse adjustment of said straps around the water heater, and wherein said adjustable fastener is configured to tighten said straps around the water heater.

24. The restraining system of claim 23, further comprising a first wedge, said first wedge including a first leg and a second leg, a second wedge, said second wedge including a first leg and a second leg, and wherein said first strap is connected to said first wedge and said second strap is connected to said second wedge.

25. The restraining system of claim 23, further comprising a bracket having two generally parallel sides extending in opposing directions and joined by a member extending between them to form a Z-shaped bracket, with one of the parallel sides being connected to one of the first or second straps.

26. A restraining system for securing a water heater to a support structure, comprising:

a first strap having a first end adapted to be connected to the support structure, said first strap having a plurality of holes at a distal, second end of the first strap;

a second strap having a first end adapted to be connected to the support structure, said second strap having at least one hole at a distal, second end of the second strap;

a first connector having a first extension, a body, and a second extension, said first and second extensions configured to extend through selected holes from said plurality of slots in said first strap;

an adjustable fastener configured to extend through a hole in said first connector and to further extend through said at least one hole in the second end of the second strap to move the distal ends of the two straps relative to each other.

27. The restraining system of claim 26, wherein a distance between the first and second extensions of said first connector is a multiple of the distance between adjacent slots of said plurality of slots in said first strap.

28. The restraining system of claim 27, further comprising a bracket having two generally parallel sides extending in opposing directions and joined by a member extending between them to form a Z-shaped bracket, with one of the parallel sides being connected to one of the first or second straps.

29. The restraining system of claim 26, further comprising a first wedge, said first wedge including a first leg and a second leg, a second wedge, said second wedge including a first leg and a second leg, and wherein said first strap is connected to said first wedge, and said second strap is connected to said second wedge.

30. A restraining system securing a water heater to a supporting structure, comprising:

a bracket connected to the supporting structure and having a plurality of apertures therein;

a first wedge, said first wedge having a first leg and a second leg joined at an angle relative to each other to form the first wedge, said first wedge connected to said bracket by connecting each of the non-joined ends of said legs to separate fasteners extending through selected apertures of said bracket; and a second wedge, said second wedge having a first leg and a second leg joined at an angle relative to each other to form the second wedge, said second wedge connected to said bracket by connecting each of the non-joined ends of said legs to separate fasteners extending through selected apertures of said brackets wherein said first leg of said first wedge and said first leg of said second wedge are configured to engage the water heater.

31. The restraining system of claim 30, wherein said first leg of said first wedge and said second leg of said second wedge are curved.

32. The restraining system of claim 30, further comprising:

a first strap connected to said first wedge, said first strap including a plurality of slots;

a second strap connected to said second wedge, said second strap including a plurality of slots;

a first connector, said first connector selectively connectable to said first strap;

a second connector, said second connector selectively connectable to said second strap; and an adjustable fastener, said adjustable fastener configured to join said first connector to said second connector wherein said first strap and said second strap can restrain movement of the water heater.

33. A bracket for a restraining system for securing a water heater to a supporting structure having an exterior with a square corner formed by two orthogonal surfaces such as a side and edge of a stud, comprising:

a first section;

a second section connected at a generally perpendicular angle to said first section;

a third section connected at a generally perpendicular angle to said second section and generally parallel to the first section to for a generally "Z" shaped bracket configured so the first and second sections can be fastened to the two orthogonal surfaces of the support structure during use of the bracket, said third section configured to be attached to a strap adapted to extend around at least a portion of the water heater.

34. The bracket as in claim 33, wherein said third section includes a diamond-shaped section.

35. The bracket as in claim 33, further including a top flange and a bottom flange connected to said third section, the top and bottom flanges being opposite each other on a common side of the third section.

36. The bracket as in claim 35, wherein the first section has at least one a hole therein sized to allow a fastener to be inserted through the hole to fasten the bracket to the support during use of the bracket.

37. The bracket as in claim 36, wherein the second section has a hole therein sized to allow a fastener to be inserted through the hole to fasten the bracket to the support during use of the bracket.

38. The bracket as in claim 35, wherein the second section has a hole therein sized to allow a fastener to be inserted through the hole to fasten the bracket to the support during use of the bracket.

39. The bracket of claim 33, wherein the first section has at least one hole therein sized to allow a fastener to be inserted through the hole to fasten the bracket to the support during use of the bracket.

40. The bracket as in claim 39, wherein the second section has a hole therein sized to allow a fastener to be inserted through the hole to fasten the bracket to the support during use of the bracket.

41. The bracket as in claim 33, wherein the second section has a hole therein sized to allow a fastener to be inserted through the hole to fasten the bracket to the support during use of the bracket.

42. The bracket as in claim 33, wherein the bracket is fastened to a support so the first and second sections abut the support, with a fastener extending through at least one of the first and second sections to fasten the bracket to the support during use of the bracket.

43. A restraining system for securing a water heater to a supporting structure, comprising:

a first strap having a first end and a second end, said second end including a plurality of openings;

a connector selectively connectable to said first strap through at least one of said openings in said first strap;

a second strap having a first end and a second end, said second end including an opening;

an adjustable fastener configured to fit through said opening in said second end of said second strap and connect said second strap to said first connector.

44. The restraining system as defined in claim 43, further comprising means for connecting at least one of the first ends to a wall.

45. A restraining system for securing a water heater to support structure, comprising:

a first strap having a first end and a second end, said second end including a plurality of openings;

a second strap having a first end and a second end, said second end including a plurality of openings; and means cooperating with the plurality of openings in the first and second ends for adjustably connecting said first end of said first strap and said first end of said second strap around the water heater to restrain movement of the water heater.

46. The restraining system as defined in claim 45, further comprising means for connecting at least one of the first ends to a wall.

47. The restraining system of claim 46, wherein the means for connecting to a wall includes a bracket, comprising:

a first section;

a second section connected at a generally perpendicular angle to said first section;

a third section connected at a generally perpendicular angle to said second section and generally parallel to the first section, said third section configured to be attached to the strap.

48. The restraining system of claim 47, wherein at least one of the first and second sections have a hole therein sized to allow a fastener to be inserted through the hole to fasten the bracket to the support.

49. The restraining system of claim 45, wherein the means for adjustably connecting the first ends of the straps comprises at least one U-shaped member having two legs that extend through the holes with a threaded fastener connecting to one leg of the U-shaped member, the legs being spaced apart a distance sufficient to align the legs with corresponding holes in the straps.

50. The restraining system of claim 49, wherein the U-shaped member has one has leg longer than the other leg.

51. A method of restraining a water heater from movement, comprising the steps of:

providing a first strap having a first end and a second end, said second end including a plurality of holes;

providing a second strap having a first end and a second end, said second end including a plurality of holes;

inserting a first connector through one or more selected holes from said plurality of holes in said first strap, said first connector including an aperture, said one or more selected holes selected for coarse adjustment of said first strap around the water heater;

inserting a second connector through one or more selected holes from said plurality of holes in said second strap, said second connector including an aperture, said one or more selected holes selected for coarse adjustment of said second strap around the water heater; and inserting an adjustable fastener through said apertures in said first connector and second connectors to adjustably connect said first connector and said second connector to provide fine adjustment of the first and second straps around the water heater.

52. A method of restraining a water heater from movement, comprising the steps of:

attaching a first end of a first strap to a supporting structure, said first strap including a plurality of holes;

attaching a first end of a second strap to the supporting structure, said second strap including a plurality of holes;

inserting a first connector through selected holes of said plurality of holes in said first strap;

inserting a second connector through selected holes of said plurality of holes in said second strap;

connecting said first connector and said second connector with an adjustable fastener, said adjustable fastener configured to tighten said first strap and said second strap around the water heater.

53. A bracket for a restraining system for securing a water heater to a supporting structure, comprising:

a first section having a hole therein sized to allow a fastener to be inserted through the hole to fasten the bracket to the structure during use of the bracket.

a second section connected at a generally perpendicular angle to said first section;

a third section connected at a generally perpendicular angle to said second section and generally parallel to the first section, said third section configured to be attached to a strap adapted to extend around at least a portion of the water heater, the first, second and third sections are permanently joined to form a single part.

54. The bracket of claim 53, wherein the second section has a hole therein sized to allow a fastener to be inserted through the second hole to fasten the bracket to the structure during use of the bracket.

* * * * *